US007466271B2

(12) United States Patent
Wen et al.

(10) Patent No.: US 7,466,271 B2
(45) Date of Patent: Dec. 16, 2008

(54) MULTIPLE-BAND ANTENNA WITH PATCH AND SLOT STRUCTURES

(75) Inventors: Geyi Wen, Waterloo (CA); Perry Jarmuszewski, Waterloo (CA); Adam D. Stevenson, Waterloo (CA)

(73) Assignee: Research In Motion Limited, Ontario (CA)

( * ) Notice: Subject to any disclaimer, the term of this patent is extended or adjusted under 35 U.S.C. 154(b) by 0 days.

(21) Appl. No.: 11/838,751

(22) Filed: Aug. 14, 2007

(65) Prior Publication Data

US 2008/0030411 A1 Feb. 7, 2008

Related U.S. Application Data

(63) Continuation of application No. 11/456,025, filed on Jul. 6, 2006, now Pat. No. 7,283,097, which is a continuation of application No. 10/723,840, filed on Nov. 26, 2003, now Pat. No. 7,224,312.

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 725, 745, 770
See application file for complete search history.

(56) References Cited

U.S. PATENT DOCUMENTS

| | | | | |
|---|---|---|---|---|
| 6,049,314 | A | 4/2000 | Munson et al. | 343/846 |
| 6,140,966 | A | 10/2000 | Pankinaho | 343/700 MS |
| 6,157,348 | A | 12/2000 | Openlander | 343/846 |
| 6,343,208 | B1 | 1/2002 | Ying | 455/575.7 |
| 6,408,190 | B1 | 6/2002 | Ying | 455/553 |
| 6,466,170 | B2 * | 10/2002 | Zhou | 343/700 MS |
| 6,670,923 | B1 | 12/2003 | Kadambi et al. | 343/700 MS |
| 7,023,387 | B2 * | 4/2006 | Wen et al. | 343/700 MS |
| 7,136,024 | B2 | 11/2006 | Yuanzhu et al. | 343/767 |
| 7,145,516 | B2 | 12/2006 | Ko et al. | 343/767 |
| 7,151,493 | B2 | 12/2006 | Wen et al. | 343/767 |
| 7,224,312 | B2 * | 5/2007 | Wen et al. | 343/700 MS |

(Continued)

FOREIGN PATENT DOCUMENTS

CN 1338796 A 3/2002

(Continued)

*Primary Examiner*—Tan Ho
(74) *Attorney, Agent, or Firm*—Allen, Dyer, Doppelt, Milbrath & Gilchrist P.A.

(57) ABSTRACT

A multiple-band antenna having first and second operating frequency bands is provided. The antenna includes a first patch structure associated primarily with the first operating frequency band, a second patch structure electrically coupled to the first patch structure and associated primarily with the second operating frequency band, a first slot structure disposed between a first portion of the first patch structure and the second patch structure and associated primarily with the first operating frequency band, and a second slot structure disposed between a second portion of the first patch structure and the second patch structure and associated primarily with the second operating frequency band. A mounting structure for the multiple-band antenna is also provided. The mounting structure includes a first surface and a second surface opposite to and overlapping the first surface. The first and second patch structures are mounted to the first surface, and a feeding point and ground point, respectively connected to the first and second patch structures, are mounted to the second surface.

27 Claims, 7 Drawing Sheets

U.S. PATENT DOCUMENTS

| | | | | |
|---|---|---|---|---|
| 7,239,279 | B2 * | 7/2007 | Wen et al. | 343/700 MS |
| 7,256,741 | B2 * | 8/2007 | Wen et al. | 343/700 MS |
| 7,283,097 | B2 * | 10/2007 | Wen et al. | 343/700 MS |
| 2001/0050635 | A1 | 12/2001 | Weinberger | 343/700 |
| 2003/0011521 | A1 | 1/2003 | Edimo et al. | 343/700 MS |
| 2004/0026039 | A1 | 2/2004 | Goto et al. | 156/345.41 |
| 2004/0164906 | A1 | 8/2004 | Shih | 343/700 MS |
| 2006/0244668 | A1 | 11/2006 | Iellici et al. | 343/726 |

FOREIGN PATENT DOCUMENTS

| | | |
|---|---|---|
| EP | 1172885 | 1/2002 |
| EP | 1241733 | 9/2002 |
| WO | 0227859 | 4/2002 |
| WO | 0227862 | 4/2002 |

* cited by examiner

MULTIPLE-BAND ANTENNA WITH PATCH AND SLOT STRUCTURES

This application is a continuation of Ser. No. 11/456,025 filed Jul. 6, 2006 now U.S. Pat. No. 7,283,097 which is a continuation of Ser. No. 10/723,840 filed Nov. 26, 2003 now U.S. Pat. No. 7,224,312, which claims the benefit of International Application No. PCT/CA02/01842 filed Nov. 28, 2002, the entire disclosures of which are hereby incorporated herein by reference.

FIELD OF THE INVENTION

This invention relates generally to the field of antennas. More specifically, a multi-band antenna is provided that is particularly well-suited for use in wireless mobile communication devices, generally referred to herein as "mobile devices", such as Personal Digital Assistants, cellular telephones, and wireless two-way email communication devices.

BACKGROUND OF THE INVENTION

Mobile devices having structures that support multi-band communications are known. Many such mobile devices utilize helix, "inverted F" or retractable structures. Helix and retractable antennas are typically installed outside of a mobile device, and inverted F antennas are typically embedded inside of a case or housing of a device. Generally, embedded antennas are preferred over external antennas for mobile communication devices for mechanical and ergonomic reasons. Embedded antennas are protected by the mobile device case or housing and therefore tend to be more durable than external antennas. Although external antennas may physically interfere with the surroundings of a mobile device and make a mobile device difficult to user particularly in limited-space environments, embedded antennas present fewer such challenges.

In some types of mobile devices, however, known embedded structures and design techniques provide relatively poor communication signal radiation and reception, at least in certain operating positions of the mobile devices. One of the biggest challenges for mobile device antenna design is to ensure that the antenna operates effectively in different positions, since antenna position changes as a mobile device is moved. Typical operating positions of a mobile device include, for example, a data input position, in which the mobile device is held in one or both hands such as when a user is entering a telephone number or email message, a voice communication position, in which the mobile device may be held next to a user's head and a speaker and microphone are used to carry on a conversation, and a "set down" position, in which the mobile device is not in use by the user, and is set down on a surface, placed in a holder, or stored in or on some other storage apparatus. In these positions, the user's head, hands and body, the surface, the holder, and the storage apparatus can all block the antenna and degrade its performance. Although the mobile device is not actively being used by the user when in the set down position, the antenna should still operate in this position to at least receive communication signals. Known embedded antennas tend to perform relatively poorly, particularly when a mobile device is in a voice communication position.

SUMMARY

According to an aspect of the invention, a multiple-band antenna having first and second operating frequency bands comprises first patch structure associated primarily with the first operating frequency band, a second patch structure electrically coupled to the first patch structure and associated primarily with the second operating frequency band, a first slot structure disposed between a first portion of the first patch structure and the second patch structure and associated primarily with the first operating frequency band, and a second slot structure disposed between a second portion of the first patch structure and the second patch structure and associated primarily with the second operating frequency band.

A multiple-band antenna system according to another aspect of the invention comprises a multiple-band antenna and a mounting structure. The multiple-band antenna system has first and second operating frequency bands and comprises a first patch structure, a second patch structure electrically coupled to the first patch structure, a first slot structure disposed between a first portion of the first patch structure and the second patch structure, a second slot structure disposed between a second portion of the first patch structure and the second patch structure, a feeding point electrically coupled to the first patch structure, and a ground point electrically coupled to the second patch structure, wherein the first patch structure and the first slot structure form major radiating and receiving structures for the first operating frequency band, and the second patch structure and the second slot structure form major radiating and receiving structures for the second operating frequency band. The mounting structure comprises a first surface and a second surface opposite to and overlapping the first surface. The first and second patch structures are mounted to the first surface, and the feeding point and ground point are mounted to the second surface.

A wireless mobile communication device incorporating a multiple-band antenna is also provided. The wireless mobile communication device comprises a first transceiver adapted to transmit and receive communication signals in a first frequency band, a second transceiver adapted to transmit and receive communication signals in a second frequency band, and a multiple-band antenna connected to the first transceiver and the second transceiver. The multiple-band antenna comprises a first patch structure associated primarily with the first frequency band, a second patch structure electrically coupled to the first patch structure and associated primarily with the second frequency band, a first slot structure disposed between a first portion of the first patch structure and the second patch structure and associated primarily with the first frequency band, and a second slot structure disposed between a second portion of the first patch structure and the second patch structure and associated primarily with the second frequency band.

Further features and aspects of the invention will be described or will become apparent in the course of the following detailed description.

DETAILED DESCRIPTION

Structures in the multiple-band antenna described herein are sized and shaped to tune the multiple-band antenna for operation in multiple frequency bands. In an embodiment of the invention described in detail below, the multiple-band antenna includes structures which are primarily associated with one of a first operating frequency band and a second operating frequency band, thus enabling the multiple-band antenna to function as the antenna in, a multi-band mobile device. For example, a multiple-band antenna may be adapted for operation at the Global System for Mobile communications (GSM) 900 MHz frequency band and the Personal Communication System (PCS) frequency band. Those skilled in the art will appreciate that the GSM-900 band includes a transmit sub-band of 880-915 MHz and a receive sub-band 925-960 MHz, and the PCS frequency band similarly includes a transmit sub-band of 1850-1910 MHz and a receive sub-band of 1930-1990 MHz. It will also be appreciated by those skilled in the art that these frequency bands are for illustrative purposes only. Such an antenna may instead be designed to operate in other pairs of operating frequency bands.

Figure 1:
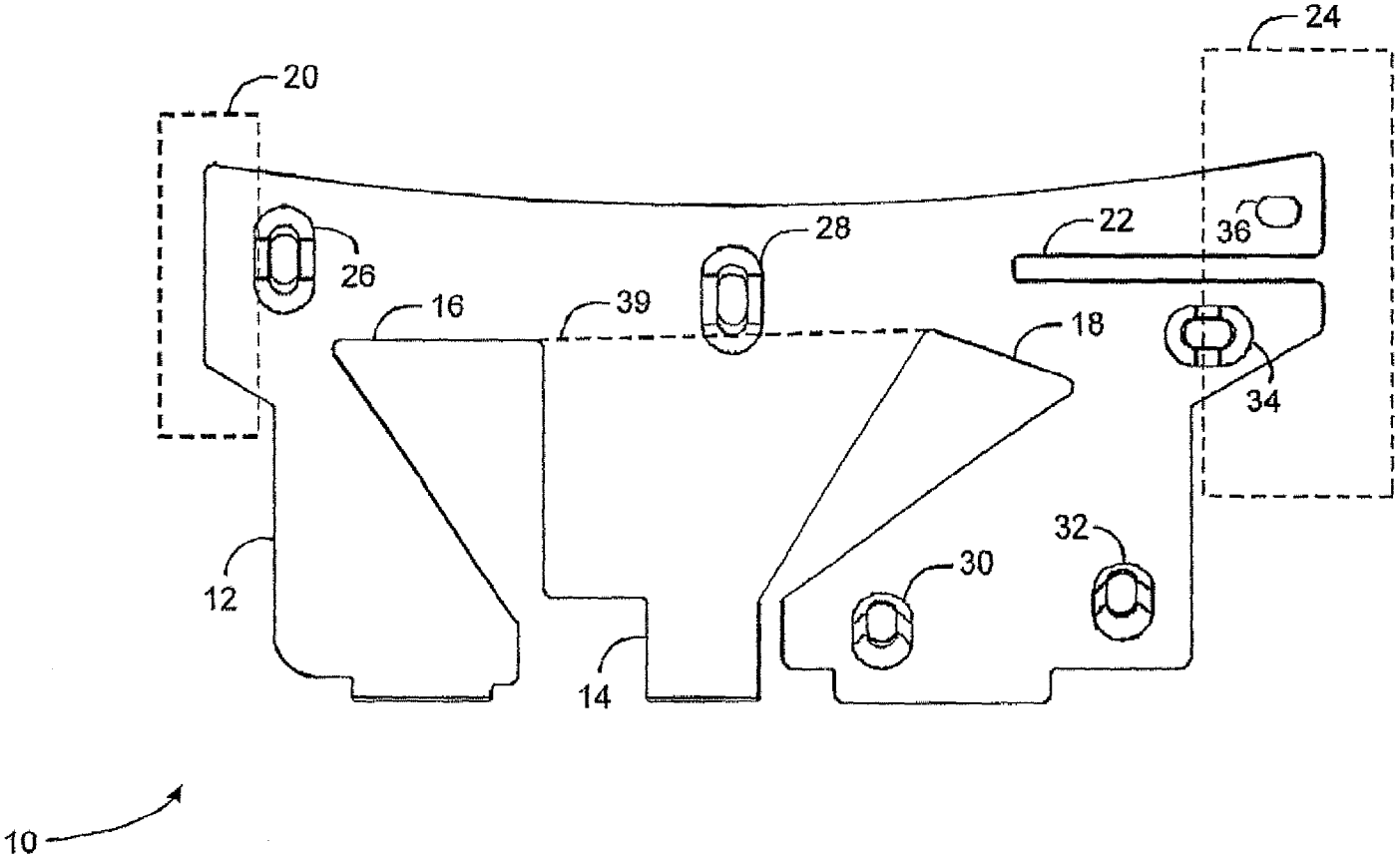
FIG. 1 is a top view of a multiple-band antenna according to an embodiment of the invention.

FIG. 1 is a top view of a multiple-band antenna according to an embodiment of the invention. The multiple-band antenna 10 includes the structures 12,14, 16,18, 20,22, and 24, as well as mounting bores 26,28, 30,32, 34, and 36. The mounting bores 26,28, 30,32, 34, and 36 are used to mount the antenna to a mounting structure, as will be described in further detail below in conjunction with FIG. 4.

The multiple-band antenna 10 includes patch structures 12 and 14, slot structures 16 and 18, and tuning structures 20,22, and 24. Patch antennas are popular for their low profile and virtually unlimited possible shapes and sizes, and inherent flexibility which allows them to be made to conform to most surface profiles. Patch antenna polarizations can be linear or elliptical, with a main polarization component parallel to the surface of the patch. Slot antennas are used to enhance the field strength in required directions by changing their orientations. Operating characteristics of patch and slot antennas are established by antenna shape and dimensions. Principles of operation of patch and slot antennas are well-known to those skilled in the art to which the present application pertains.

In the multiple-band antenna 10, the patch structure 12 is a first structure associated primarily with a first frequency band in which the multiple-band antenna 10 operates. The patch structure 12 is generally C-shaped, including two end portions, at the left- and right-hand sides of the multiple-band antenna 10 in the view shown in FIG. 1, and an adjoining portion, along the top of the multiple-band antenna 10. The size and shape of the patch structure 12 have a most pronounced effect on antenna operating characteristics in the first frequency band, such as the actual frequency of the first frequency band, as well as antenna gain in the first frequency band. Of course, in any multiple-band antenna such as 10, changes in a part of the antenna associated with one frequency band may also affect other operating frequency bands of the antenna, although in the multiple-band antenna 10, the effects of the right-hand end portion of the structure 12 on the second operating frequency band are not as significant, as will be described in further detail below.

The patch structure 14 is a second structure associated primarily with a second operating frequency band of the multiple-band antenna 10. As described above for the patch structure 12, operating characteristics of the multiple-band antenna 10 in the second frequency band, including frequency and gain, for example, are primarily affected by the size and shape of the second structure 14.

The slot structures 16 and 18 are similarly adapted such that each has a dominant effect on one or the other of the first and second frequency bands. The slot structure 18 is positioned in the multiple-band antenna 10 and dimensioned to affect antenna operation in the first frequency band, whereas the slot structure 16 is positioned and dimensioned to primarily affect antenna operation in the second frequency band. The length and the width of each slot structure 16 and 18 not only sets the respective frequency bands of the slot structures 16 and 18, but also affects the gain and match of the antenna 10 at these frequency bands. For example, changing the width and length of the slot structures 16 and 18 may improve antenna match, but sacrifice gain.

The patch structures 12 and 14 are shorted along the line 39 in FIG. 1. The multiple-band antenna 10 is operable with different shorting lengths between the patch structures 12 and 14 along the line 39. This provides flexibility in the design of the multiple-band antenna 10 in that the positions and dimensions of either or both of the slot structures 16 and 18 may be changed without significantly degrading performance of the multiple-band antenna 10. As shown in the illustrated embodiment, the first slot structure 16 is a generally triangularly-shaped slot structure disposed between the first end portion of the first patch structure 12 and the second patch structure 14. The first triangularly-shaped slot structure also illustratively has an apex portion and an opposing base portion. The second slot structure 18 in the illustrated embodiment may also be considered as a second triangularly-shaped slot structure disposed between the second end portion of the first patch structure 12 and the second patch structure 14. The second triangularly-shaped slot structure also illustratively has an apex portion and an opposing base portion. As further shown in the illustrated embodiment, the second slot structure 18 may be considered as having a second rectangularly-shaped slot structure coupled to the apex portion of the second triangularly-shaped slot structure. Similarly, the first slot structure 16 may be considered as further comprising a first rectangularly-shaped slot structure coupled to the apex portion of the first triangularly-shaped slot structure, and with the first rectangularly-shaped slot structure being illustratively larger in area than the second rectangularly-shaped slot structure.

Tuning structures 20,22, and 24 are used for fine-tuning the multiple-band antenna 10. Although connected to the first patch structure 12, the tuning structure 20 forms a tuning tab for the second frequency band. As described in further detail below, the left-hand end portion of the first patch structure 12 is a shared portion which is used when the multiple-band antenna 10 is operating in either the first frequency band or the second frequency band. However, the dimensions of the tuning structure 20 have a dominant effect on the second frequency band. Thus, fine tuning of the second frequency band is accomplished by setting the dimensions of the fine tuning tab 20.

The tuning structure 22 is also for fine tuning of the second frequency band. By changing the length of the tuning structure 22, the match and gain of the second frequency band can be tuned as required.

Fine tuning of the multiple-band antenna 10 in the first frequency band is provided by the tuning structure 24. The tuning tabs in the tuning structure 24 affect the overall electrical length, and thus the operating frequency band, of the first structure 12. Even though the dimensions of the tabs in the tuning structure 24 also affect the dimensions of the slot in the tuning structure 22, fine tuning for both operating bands of the antenna 10 is normally performed at the same time, so that effects of fine tuning of one band are compensated by adjusting one or more tuning structures for the other band.

Figure 2:
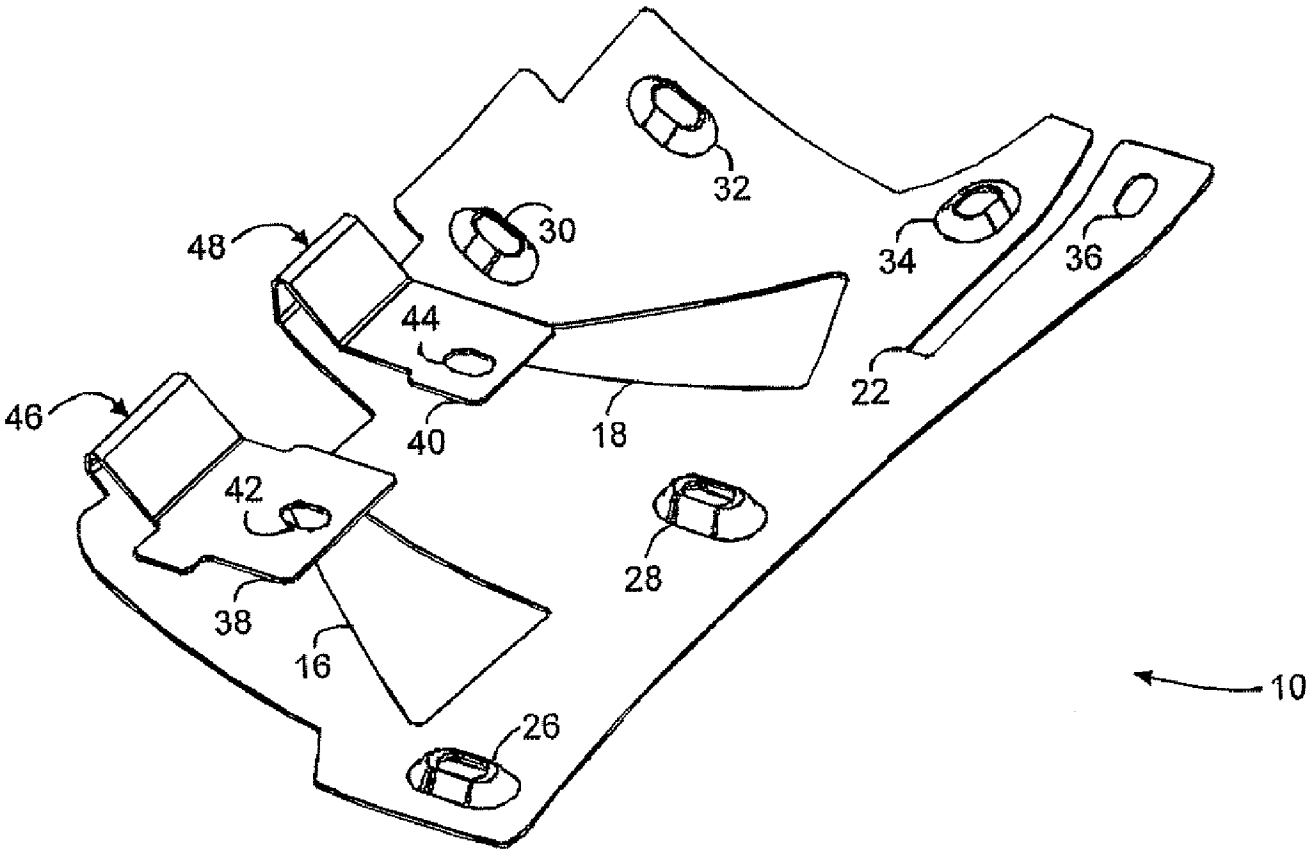
FIG. 2 is a bottom isometric view of the multiple-band antenna of FIG. 1.

Referring now to FIG. 2, operation of the multiple-band antenna 10 will be described in further detail. FIG. 2 is a bottom isometric view of the multiple-band antenna of FIG. 1. A feeding point 38 and ground point 40, with respective mounting bores 42 and 44, are shown in FIG. 2. The feeding point 38 and the ground point 40 form a single feeding port for the multiple-band antenna 10. When installed in a mobile device, the ground point 40 is connected to signal ground to form a ground plane for the multiple-band antenna 10, and the feeding point 38 is coupled to one or more transceivers operable to send and/or receive signals in the first and second frequency bands.

Signals in the first and second frequency bands, established as described above, are received and radiated by the multiple-band antenna 10. An electromagnetic signal in the first or second frequency band is received by the multiple-band antenna 10 and converted into an electrical signal for a corresponding receiver or transceiver coupled to the feeding point 38 and ground point 40. Similarly, an electrical signal in the first frequency band which is input to the multiple-band antenna 10 via the feeding point 38 and ground point 40 by a transmitter or transceiver is radiated from the multiple-band antenna 10. When operating in the first frequency band, the structures 12 and 18 of the multiple-band antenna 10 radiate and receive signals polarized in directions both parallel and perpendicular to the patch structure 12 in a co-operative manner to enhance the gain.

In the second frequency band, operation of the multiple-band antenna 10 is substantially similar. In this case, however, the structures 14 and 16 are the major radiating and receiving components.

Therefore, the multiple-band antenna 10 offers improved signal transmission and reception relative to known antenna designs, since it uses a combined structure of a patch and slot antenna which work co-operatively and basically radiates and receives signals polarized in most popular directions. In this manner, the performance of the multiple-band antenna 10 is less affected by orientation of a mobile device, such as in the data input position, the voice communication position, and the set down position described above.

Figure 3:
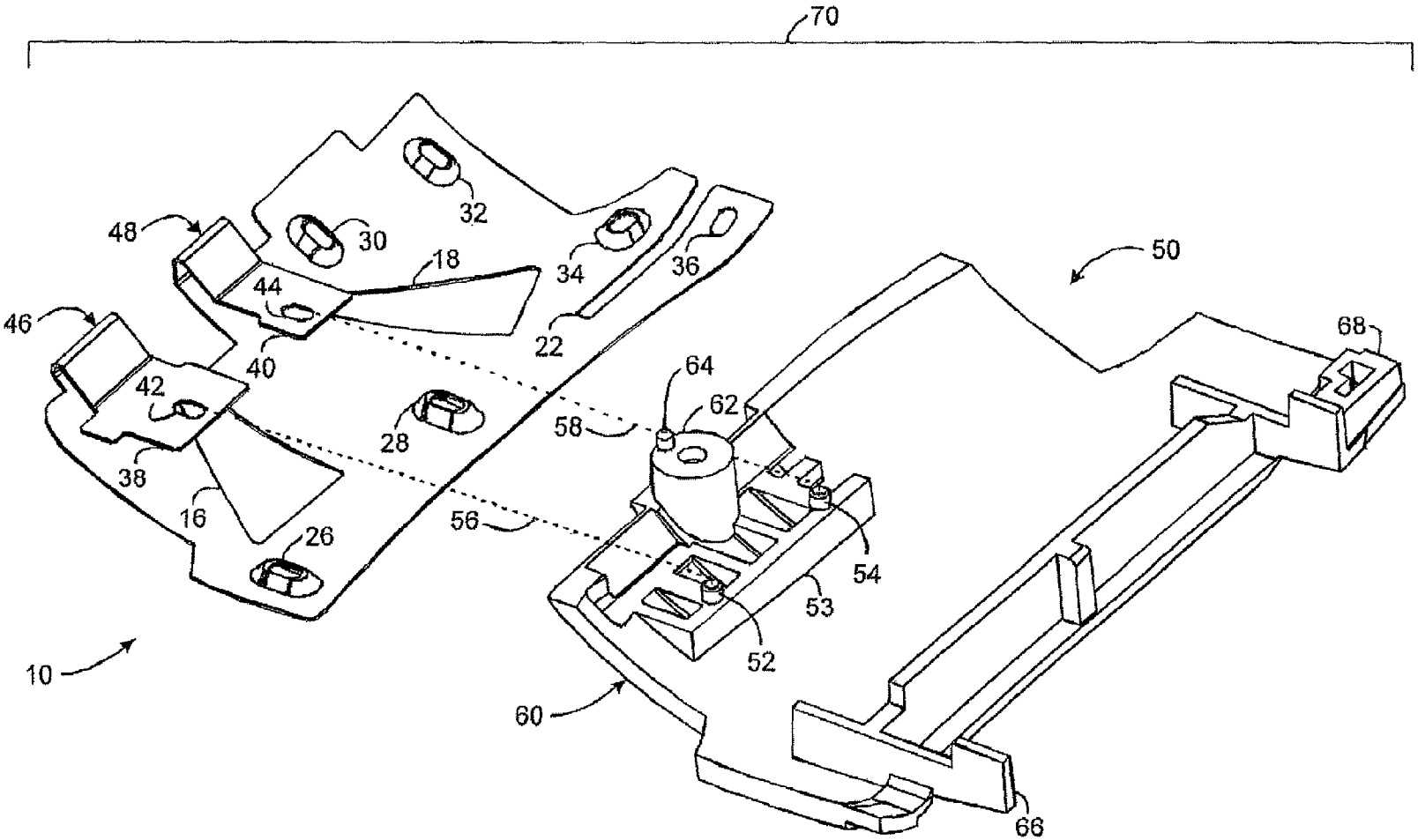
FIG. 3 is a bottom isometric view of the multiple-band antenna of FIG. 1 and an antenna mounting structure.
Figure 4:
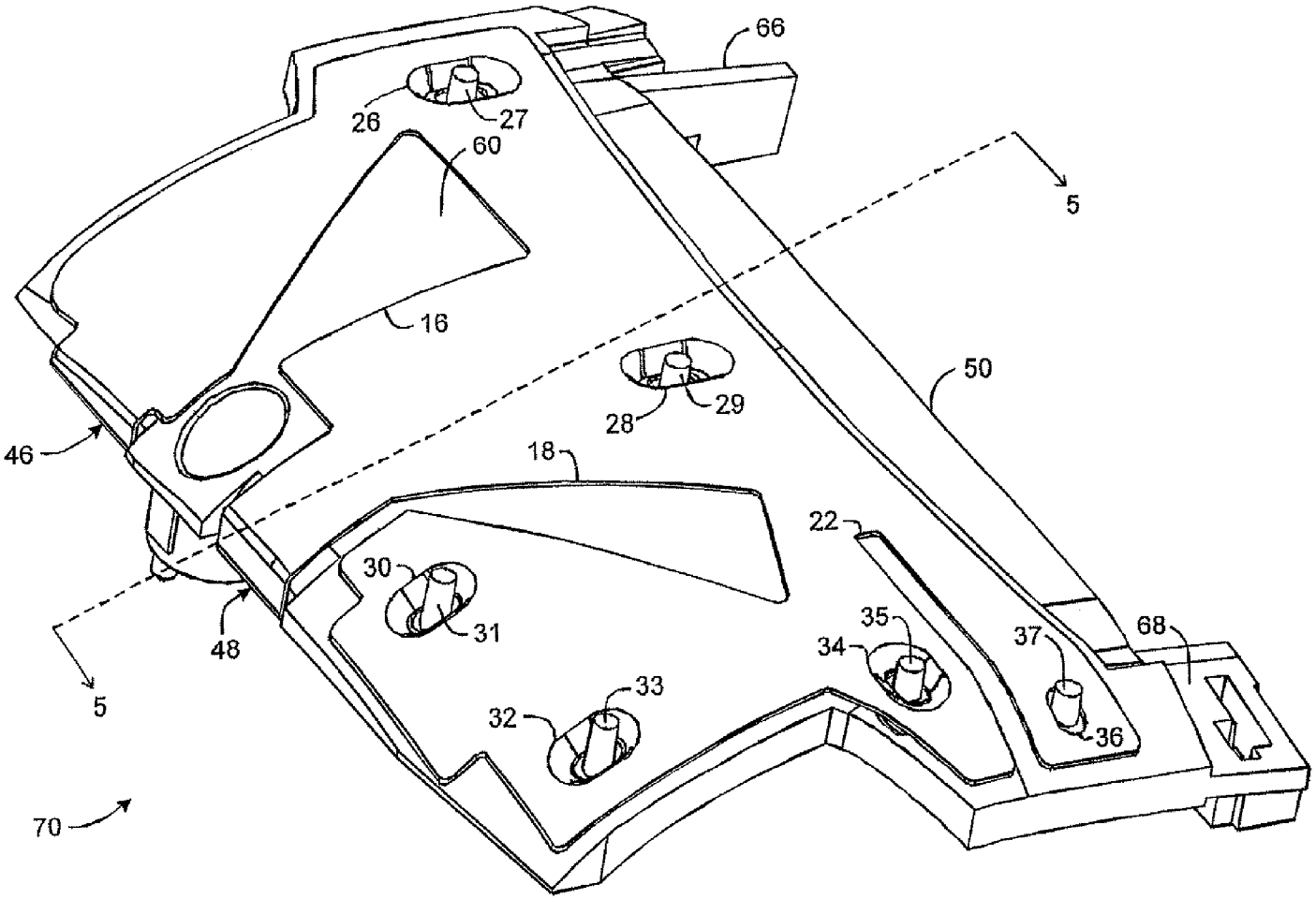
FIG. 4 is a top isometric view of the antenna and mounting structure of FIG. 3 in an assembled position.
Figure 5:
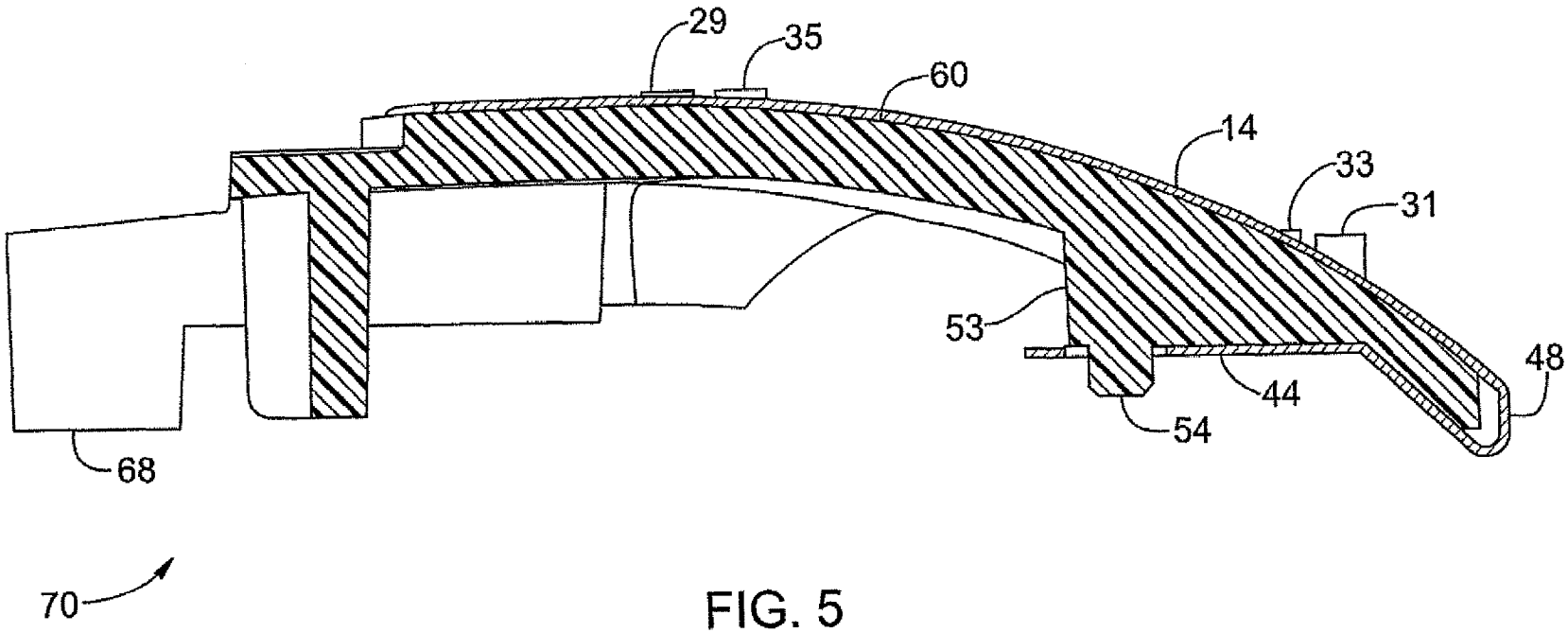
FIG. 5 is a cross-sectional view of the antenna and mounting structure along line 5-5 of FIG. 4.

Performance of the multiple-band antenna 10 is further enhanced when the antenna is mounted on a mounting structure as shown in FIGS. 3-5. FIG. 3 is a bottom isometric view of the multiple-band antenna of FIG. 1 and an antenna mounting structure, FIG. 4 is a top isometric view of the antenna and mounting structure of FIG. 3 in an assembled position, and FIG. 5 is a cross-sectional view of the antenna and mounting structure along line 5-5 of FIG. 4.

In FIG. 3, the multiple-band antenna 10 is shown substantially as in FIG. 2, and has been described above. The mounting structure 50 is preferably made of plastic or other dielectric material, and includes mounting pins 52 and 54 on a support structure 53, and a preferably smooth non-planar mounting surface 60. The mounting structure 50 also includes a fastener structure 62, an alignment pin 64, and other structural components 66 and 68 which cooperate with housing sections or other parts of a mobile device in which the antenna is installed. For example, the alignment pin 64, serves to align the mounting structure relative to a part of a mobile device which includes a cooperating alignment hole. The fastener structure 62 is configured to receive a screw, rivet or other fastener to attach the mounting structure to another part of the mobile device once the mounting structure 50 is properly aligned. The multiple-band antenna 10 is preferably mounted to the mounting structure 50 before the mounting structure is attached to other parts of such a mobile device. The multiple-band antenna 10 and mounting structure 60 comprise an antenna system generally designated 70 in FIG. 3.

The mounting pins 52 and 54 are positioned on the support structure 53 so as to be received in the mounting bores 42 and 44, respectively, when the multiple-band antenna 10 is positioned for mounting as indicated by the dashed lines 56 and 58. The mounting pins 52 and 54 are then preferably deformed to mount the feeding point 38 and the ground point 40 to the support structure 53 on the mounting structure 50. The mounting pins 52 and 54 may, for example, be heat stakes which are melted to overlay a portion of the feeding point 38 and the ground point 40 surrounding the mounting bores 42 and 44 and thereby retain the feeding point 38 and the ground point 40 in a mounted position.

The top side of the antenna system 70 is shown in FIG. 4, in which the multiple-band antenna 10 is in a mounted position on the mounting structure 50. As shown, the mounting bores 26,28, 30,32, 34, and 36 receive the mounting pins 27,29, 31,33, 35, and 37, which are then preferably deformed as described above to retain the multiple-band antenna 10 in the mounted position. The multiple-band antenna 10 lies substantially against the smooth surface 60 when mounted on the mounting structure 50. The surface 60 in FIGS. 3-5 is an arced surface, although other surface profiles may instead be used.

The mounting bores 26, 28, 30,32, and 34 are surrounded by beveled surfaces, as shown in FIGS. 1-4. These beveled surfaces serve to offset or displace the mounting bores from the surface the multiple-band antenna 10, such that the cooperating mounting pins are located below the surface of the multiple-band antenna 10 when the pins are deformed to retain the multiple-band antenna 10 in its mounted position. Depending upon the physical limitations imposed by the mobile device in which the antenna system 70 is to be implemented, a smooth finished profile for the antenna system 70 or particular parts thereof might not be crucial, such that mounting bores need not be displaced from the surface of the multiple-band antenna 10. The mounting bores 36,42 and 44 are such flush mounting bores. As will be apparent from FIGS. 4 and 5, the mounting structure 50 is smooth, but not flat. In particular, the portion of the mounting structure 50 which includes the mounting pin 37 tapers away from the remainder of the surface 60, such that the mounting pin 37 lies below the other mounting pins 27,29, 31,33, and 35. This is evident from FIG. 5, for example, in which only the mounting pins 29,31, 33, and 35 are shown.

Similarly, the feeding point 38 and ground point 40 are disposed below a surface of the multiple-band antenna 10, where a smooth finished profile might not be important. Thus, a multiple-band antenna may include offset mounting bores such as 26, 28, 30, 32, and 34, flush mounting bores such as 36, 42, and 44, or both.

The multiple-band antenna 10 may, for example, be fabricated from a substantially flat conductive sheet of a conductor such as copper, aluminum, silver, or gold, using stamping or other cutting techniques, to form antenna blanks. Mounting bores may be cut or stamped as the blanks are formed, or drilled into the flat antenna blanks. Antenna blanks are then deformed into the shape shown in FIGS. 2 and 3 to conform to the mounting structure 50. Alternatively, deformation of an antenna blank could be performed while an antenna is being mounted to the mounting structure 50. The feeding point 38 and ground point 40 are bent at 46 and 48 to position the feeding point 38 and ground point 40 relative to the structures 12 and 14, as described in further detail below.

As shown in FIGS. 3-5, the multiple-band antenna 10 includes bent portions 46 and 48 which respectively couple the feeding point 38 and the ground point 40 to the first structure 12 and second structure 14. The first structure 12 and the second structure 14 comprise a first surface of the structure, which conforms to a first surface, the surface 60, of the mounting structure 50 when the multiple-band antenna 10 is in its mounted position. The bent portions 46 and 48 position the feeding point 38 and ground point 40 on a second surface of the mounting structure 50 opposite to and overlapping the first surface of the mounting structure 50. The feeding point 38 and ground point 40 thus overlap or oppose the first and second structures 12 and 14.

As those skilled in the art will appreciate, the bent portions 46 and 48 add electrical length to the first and second structures 12 and 14, providing a further means to control antenna gain and frequency for the first and second frequency bands. Also, as shown most clearly in FIG. 5, the bent portion 48 orients the ground point 40 opposite the second antenna element 14, which introduces a capacitance between parts of the multiple-band antenna 10. The distance between the ground point 40, which forms the ground plane of the multiple-band antenna 10, and the second structure 14 affects the capacitance between the ground plane and the multiple-band antenna 10, which in turn affects antenna gain and match. Antenna gain and match can thereby be enhanced by selecting the distance between the ground plane and the multiple-band structure 10, and establishing dimensions of the support structure 53 accordingly.

Figure 6:
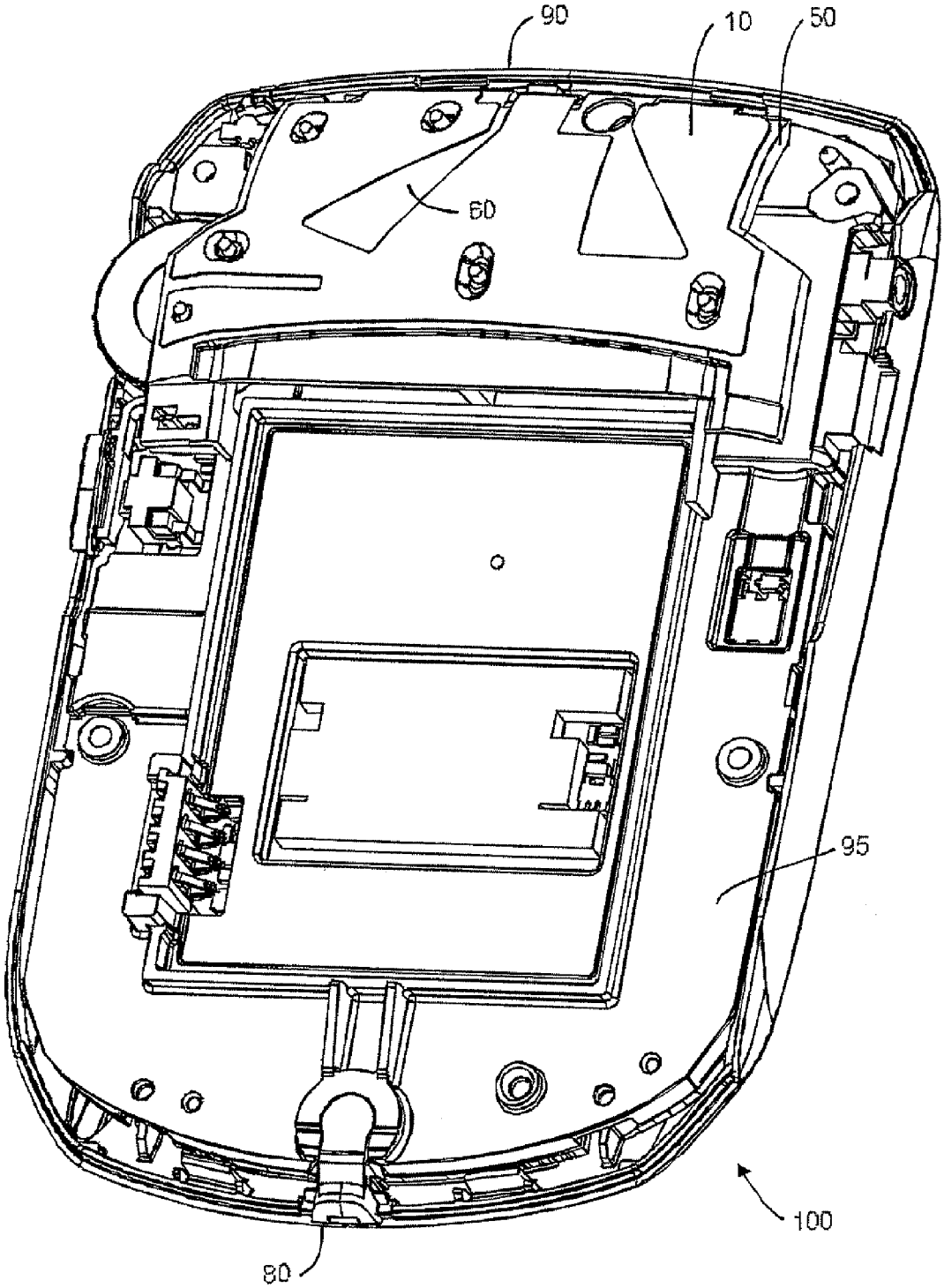
FIG. 6 is a rear view of a mobile device incorporating the multiple-band antenna and mounting structure of FIG. 4.

FIG. 6 is a rear view of a mobile device incorporating the multiple-band antenna and mounting structure of FIG. 4. As will be apparent to those skilled in the art, the mobile device 100 is normally substantially enclosed within a housing having front, rear, top, bottom, and side surfaces. Data input and output devices such as a display and a keypad or keyboard are normally mounted within the front surface of a mobile device. A speaker and microphone for voice input and output are typically disposed in the front surface, or alternatively in the top or bottom surface, of the mobile device. Such mobile devices often incorporate a shield which reduces electromagnetic energy radiated outward from the front of the device, toward a user.

In FIG. 6, the mobile device 100 is shown with a rear housing section removed. Internal components of the mobile device 100 are dependent upon the particular type of mobile device. However, the mobile device 100 is enabled for voice communications and therefore includes at least a microphone and speaker, respectively mounted at or near a lower surface 80 and an upper surface 90 of the mobile device 100. When in use for voice communications, a user holds the mobile device 100 such that the speaker is near the user's ear and the microphone is near the user 5 mouth. The shield 95 extends around the mobile device, and in particular between the antenna 10 and the front of the mobile device 100.

Generally, a user holds a lower portion of a mobile device such as 100 with one hand when engaged in a conversation. As such, the top rear portion of the mobile device 100, and thus the multiple-band antenna 10, is relatively unobstructed when the mobile device 100 is in the voice communication position, thereby providing enhanced performance compared to known antennas and mobile devices.

In a similar manner, the location of the multiple-band antenna shown in FIG. 6 remains unobstructed in other positions of the mobile device 100. For example, since data input devices such as keyboards and keypads are typically located below a display on a mobile device, the display tends to be positioned near the top of a mobile device. On such a mobile device, a user enters data using the input device, positioned on a lower section of the mobile device, and thus supports or holds the lower section of the mobile device, such that the top rear section of the mobile device remains unobstructed. Many mobile device holders and storage systems engage only the lower portion of a mobile device, and thus create no further barrier to the multiple-band antenna 10 in the mobile device 100. In other types of holders or set down positions, the multiple-band antenna 10 may be somewhat obstructed, but not to any greater degree than known embedded antennas.

Thus, the multiple-band antenna 10, mounted in a mobile device as shown in FIG. 6, not only radiates and receives in plurality of planes of polarization as described above, but is also located in the mobile device so as to be substantially unobstructed in typical use positions of the mobile device.

Figure 7:
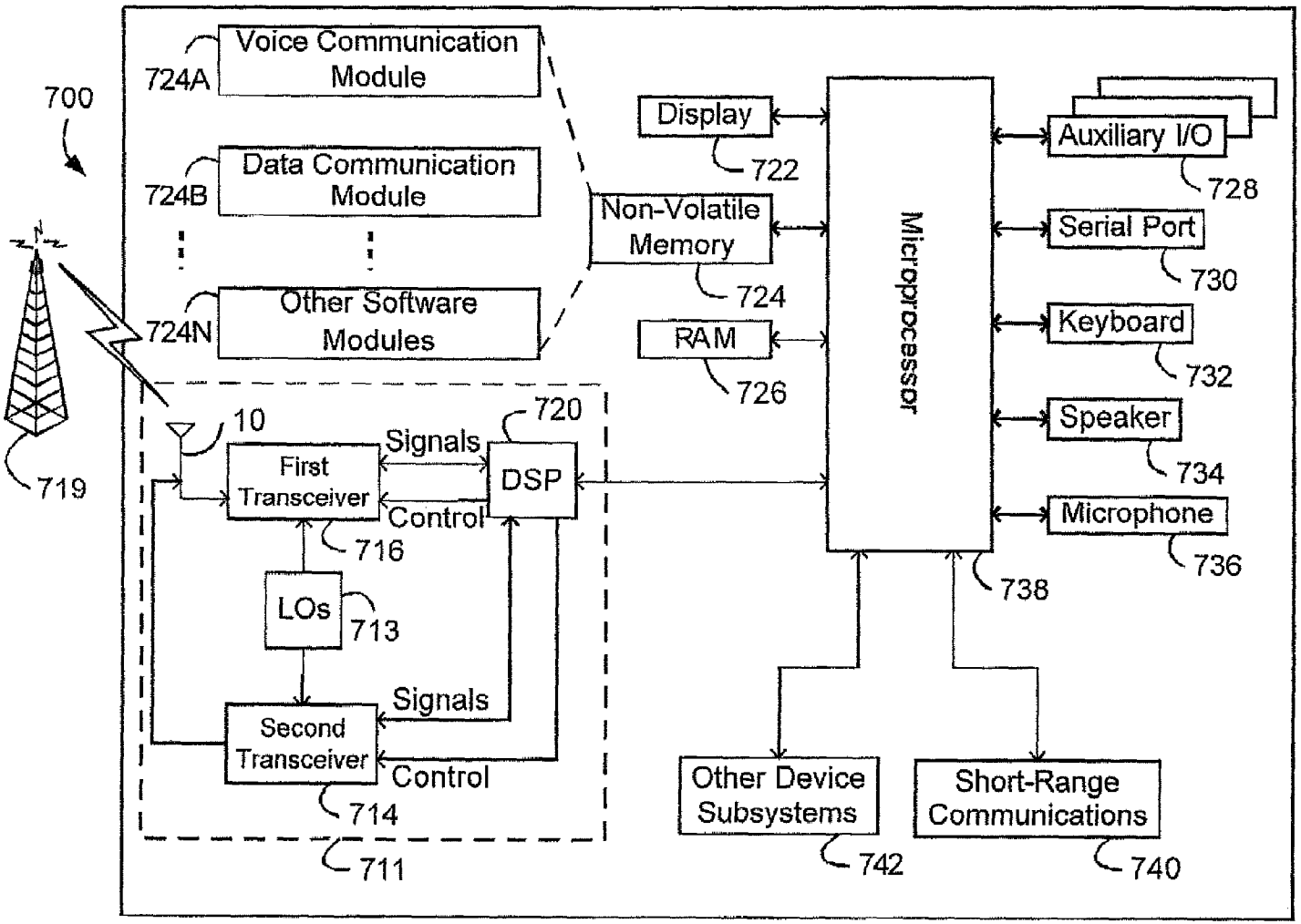
FIG. 7 is a block diagram of an example mobile device.

Multiple-element antennas according to aspects of the invention are applicable to different types of mobile device, including, for example, data communication devices, a voice communication devices, a dual-mode communication devices such as mobile telephones having data communications functionality, a personal digital assistants (PDAs) enabled for wireless communications, wireless email communication devices, or laptop or desktop computer systems with wireless modems. FIG. 7 is a block diagram of an example mobile device.

The mobile device 700 is a dual-mode and dual-band mobile device and includes a transceiver module 711, a microprocessor 738, a display 722, a non-volatile memory 724, a random access memory (RAM) 726, one or more auxiliary input/output (I/O) devices 728, a serial port 730, a keyboard 732, a speaker 734, a microphone 736, a short-range wireless communications sub-system 740, and other device sub-systems 742.

The transceiver module 711 includes a multiple-band antenna 10, a first transceiver 716, the second transceiver 714, one or more local oscillators 713, and a digital signal processor (DSP) 720.

Within the non-volatile memory 724, the device 700 preferably includes a plurality of software modules 724A-724N that can be executed by the microprocessor 738 (and/or the DSP 720), including a voice communication module 724A, a data communication module 724B, and a plurality of other operational modules 724N for carrying out a plurality of other functions.

The mobile device 700 is preferably a two-way communication device having voice and data communication capabilities. Thus, for example, the mobile device 700 may communicate over a voice network, such as any of the analog or digital cellular networks, and may also communicate over a data network. The voice and data networks are depicted in FIG. 7 by the communication tower 719. These voice and data networks may be separate communication networks using separate infrastructure, such as base stations, network controllers, etc., or they may be integrated into a single wireless network. Each transceiver 716 and 714 will normally be configured to communicate with different networks 719.

The transceiver module 711 is used to communicate with the networks 719, and includes the first transceiver 116, the second transceiver 114, the one or more local oscillators 713 and may also include the DSP 720. The DSP 720 is used to send and receive signals to and from the transceivers 714 and 716, and may also provide control information to the transceivers 714 and 716. If the voice and data communications occur at a single frequency, or closely-spaced sets of frequencies, then a single local oscillator 713 may be used in conjunction with the transceivers 714 and 716. Alternatively, if different frequencies are utilized for voice communications versus data communications for example, then a plurality of local oscillators 713 can be used to generate a plurality of frequencies corresponding to the voice and data networks 719. Information, which includes both voice and data information, is communicated to and from the transceiver module 711 via a link between the DSP 720 and the microprocessor 738.

The detailed design of the transceiver module 711, such as frequency bands, component selection, power level, etc., will be dependent upon the communication networks 719 in which the mobile device 700 is intended to operate. For example, the transceiver module 711 may include transceivers 714 and 716 designed to operate with any of a variety of communication networks, such as the Mobitex™ or DataTAC™ mobile data communication networks, AMPS, TDMA, COMA, PCS, and GSM. Other types of data and voice networks, both separate and integrated, may also be utilized where the mobile device 700 includes a corresponding transceiver.

Depending upon the type of network 719, the access requirements for the mobile device 700 may also vary. For example, in the Mobitex and DataTAC data networks, mobile devices are registered on the network using a unique identification number associated with each mobile device. In GPRS data networks, however, network access is associated with a subscriber or user of a mobile device. A GPRS device typically requires a subscriber identity module ("SIM"), which is required in order to operate a mobile device on a GPRS network. Local or non-network communication functions (if any) may be operable, without the SIM device, but a mobile device will be unable to carry out any functions involving communications over the data network 719, other than any legally required operations, such as '911' emergency calling.

After any required network registration or activation procedures have been completed, the mobile device 700 may the send and receive communication signals, including both voice and data signals, over the networks 719. Signals received by the antenna 10 from the communication network 719 are routed to one of the transceivers 714 and 716, which provides for signal amplification, frequency down conversion, filtering, channel selection, etc., and may also provide analog to digital conversion. Analog to digital conversion of the received signal allows more complex communication functions, such as digital demodulation and decoding to be performed using the DSP 720. In a similar manner, signals to be transmitted to the network 719 are processed, including modulation and encoding, for example, by the DSP 720 and are then provided to one of the transceivers 714 and 716 for digital to analog conversion, frequency up conversion, filtering, amplification and transmission to the communication network 719 via the antenna 10.

In addition to processing the communication signals, the DSP 720 also provides for transceiver control. For example, the gain levels applied to communication signals in the transceivers 714 and 716 may be adaptively controlled through automatic gain control algorithms implemented in the DSP 720. Other transceiver control algorithms could also be implemented in the DSP 720 in order to provide more sophisticated control of the transceiver module 711.

The microprocessor 738 preferably manages and controls the overall operation of the dual-mode mobile device 700. Many types of microprocessors or microcontrollers could be used here, or, alternatively, a single DSP 720 could be used to carry out the functions of the microprocessor 738. Low-level communication functions, including at least data and voice communications, are performed through the DSP 720 in the transceiver module 711. Other, high-level communication applications, such as a voice communication application 724A, and a data communication application 724B may be stored in the non-volatile memory 724 for execution by the microprocessor 738. For example, the voice communication module 724A may provide a high-level user interface operable to transmit and receive voice calls between the mobile device 700 and a plurality of other voice or dual-mode devices via the network 719. Similarly, the data communication module 724B may provide a high-level user interface operable for sending and receiving data, such as e-mail messages, files, organizer information, short text messages, etc., between the mobile device 700 and a plurality of other data devices via the networks 719. The microprocessor 738 also interacts with other device subsystems, such as the display 722, the non-volatile memory 724, the RAM 726, the auxiliary input/output (I/O) subsystems 728, the serial port 730, the keyboard 732, the speaker 734, the microphone 736, the short-range communications subsystem 740, and any other device subsystems generally designated as 742.

Some of the subsystems shown in FIG. 7 perform communication-related functions, whereas other subsystems may provide "resident" or on-device functions. Notably, some subsystems, such as keyboard 732 and display 722 may be used for both communication-related functions, such as entering a text message for transmission over a data communication network, and device-resident functions such as a calculator or task list or other PDA type functions.

Operating system software used by the microprocessor 738 is preferably stored in a persistent store such as non-volatile memory 724. In addition to the operation system, which controls all of the low-level functions of the mobile device 700, the non-volatile memory 724 may include a plurality of high-level software application programs, or modules, such as a voice communication module 724A, a data communication module 724B, an organizer module (not shown), or any other type of software module 724N. The non-volatile memory 724 also may include a file system for storing data. These modules are executed by the microprocessor 738 and provide a high-level interface between a user and the mobile device 700. This interface typically includes a graphical component provided through the display 722, and an input/output component provided through the auxiliary I/O 728, the keyboard 732, the speaker 734, and the microphone 736. The operating system, specific device applications or modules, or parts thereof, may be temporarily loaded into a volatile store, such as RAM 726 for faster operation. Moreover, received communication signals may also be temporarily stored to RAM 726, before permanently writing them to a file system located in a persistent store such as the non-volatile memory 724. The non-volatile memory 724 may be implemented, for example, as a Flash memory component, or a battery backed-up RAM.

An exemplary application module 724N that may be loaded onto the mobile device 700 is a personal information manager (PIM) application providing PDA functionality, such as calendar events, appointments, and task items. This module 724N may also interact with the voice communication module 724A for managing phone calls, voice mails, etc., and may also interact with the data communication module for managing e-mail communications and other data transmissions. Alternatively, all of the functionality of the voice communication module 724A and the data communication module 724B may be integrated into the PIM module.

The non-volatile memory 724 preferably provides a file system to facilitate storage of PIM data items on the device. The PIM application preferably includes the ability to send and receive data items, either by itself, or in conjunction with the voice and data communication modules 724A, 724B, via the wireless networks 719. The PIM data items are preferably seamlessly integrated, synchronized and updated, via the wireless networks 719, with a corresponding set of data items stored or associated with a host computer system, thereby creating a mirrored system for data items associated with a particular user.

The mobile device 700 may also be manually synchronized with a host system by placing the device 700 in an interface cradle, which couples the serial port 730 of the mobile device 700 to the serial port of the host system. The serial port 730 may also be used to enable a user to set preferences through an external device or software application, or to download other application modules 724N for installation. This wired download path may be used to load an encryption key onto the device, which is a more secure method than exchanging encryption information via the wireless network 719. Interfaces for other wired download paths may be provided in the mobile device 700, in addition to or instead of the serial port 730. For example, a USB port would provide an interface to a similarly equipped personal computer.

Additional application modules 724N may be loaded onto the mobile device 700 through the networks 719, through an auxiliary I/O subsystem 728, through the serial port 730, through the short-range communications subsystem 740, or through any other suitable subsystem 742, and installed by a user in the non-volatile memory 724 or RAM 726. Such flexibility in application installation increases the functionality of the mobile device 700 and may provide enhanced on-device functions, communication-related functions, or both. For example, secure communication applications may enable electronic commerce functions and other such financial transactions to be performed using the mobile device 700.

When the mobile device 700 is operating in a data communication mode, a received signal, such as a text message or a web page download, will be processed by the transceiver module 711 and provided to the microprocessor 738, which will preferably further process the received signal for output to the display 722, or, alternatively, to an auxiliary I/O device 728. A user of mobile device 700 may also compose data items, such as email messages, using the keyboard 732, which is preferably a complete alphanumeric keyboard laid out in the QWERTY style, although other styles of complete alphanumeric keyboards such as the known DVORAK style may also be used. User input to the mobile device 700 is further enhanced with a plurality of auxiliary I/O devices 728, which may include a thumbwheel input device, a touchpad, a variety of switches, a rocker input switch, etc. The composed data items input by the user may then be transmitted over the communication networks 719 via the transceiver module 711.

When the mobile device 700 is operating in a voice communication mode, the overall operation of the mobile device is substantially similar to the data mode, except that received signals are preferably be output to the speaker 734 and voice signals for transmission are generated by a microphone 736. Alternative voice or audio I/O subsystems, such as a voice message recording subsystem, may also be implemented on the mobile device 700. Although voice or audio signal output is preferably accomplished primarily through the speaker 734, the display 722 may also be used to provide an indication of the identity of a calling party, the duration of a voice call, or other voice call related information. For example, the microprocessor 738, in conjunction with the voice communication module and the operating system software, may detect the caller identification information of an incoming voice call and display it on the display 722.

A short-range communications subsystem 740 is also included in the mobile device 700. For example, the subsystem 740 may include an infrared device and associated circuits and components, or a short-range RF communication module such as a Bluetooth™ module or an 802.11 module to provide for communication with similarly-enabled systems and devices. Those skilled in the art will appreciate that "Bluetooth" and "802.11" refer to sets of specifications, available from the Institute of Electrical and Electronics Engineers, relating to wireless personal area networks and wireless local area networks, respectively.

This written description uses examples to disclose the invention, including the best mode, and also to enable any person skilled in the art to make and use the invention. The invention may include other examples that occur to those skilled in the art.

For example, although described above primarily in the context of a dual-band antenna, a multiple-element antenna may also include further antenna elements to provide for operation in more than two frequency bands.

The mounting structure 50 is also shown for illustrative purposes only, and may be shaped differently and include different, further, or fewer cooperating structures than those shown in the drawings and described above, depending on the particular mobile device in which the multiple-band antenna is implemented. It should also be appreciated that the mounting structure could be integral with a mobile device housing or other component of the mobile device instead of a separate component.

Layout of the multiple-band antenna is similarly intended to be illustrative and not restrictive. For example, a multiple-band antenna according to the present invention may include slot structures of a different shape than shown in the drawings, and need not necessarily incorporate fine-tuning structures. Similarly, as is typical in antenna design, the dimensions and positions of antenna structures can be adjusted as necessary to compensate for effects of other mobile device components, including a shield or display, for example, on antenna characteristics.

Although the multiple-band antenna 10 is mounted on the mounting structure 50 using mounting pins, other types of fasteners, including screws, rivets, and adhesives, for example, will be apparent to those skilled in the art.

In addition, fabrication of the multiple-band antenna 10 from a planar conductive sheet as described above simplifies manufacture of the multiple-band antenna 10, but the invention is in no way restricted to this particular, or any other, fabrication technique. Printing or depositing a conductive film on a substrate and etching previously deposited conductor from a substrate are two possible alternative techniques.

The invention claimed is:

1. A multiple-band antenna comprising:

a first patch structure comprising spaced apart first and second end portions;

a second patch structure electrically coupled to the first patch structure between the first and second end portions thereof;

a first triangularly-shaped slot structure disposed between the first end portion of the first patch structure and the second patch structure, the first triangularly-shaped slot structure having an apex portion and an opposing base portion;

a second triangularly-shaped slot structure disposed between the second end portion of the first patch structure and the second patch structure, the second triangularly-shaped slot structure having an apex portion and an opposing base portion; and a second rectangularly-shaped slot structure coupled to the apex portion of the second triangularly-shaped slot structure.

2. The multiple-band antenna of claim 1, further comprising a first rectangularly-shaped slot structure coupled to the apex portion of the first triangularly-shaped slot structure; and wherein the first rectangularly-shaped slot structure is smaller in area than the second rectangularly-shaped slot structure.

3. The multiple-band antenna of claim 1, wherein dimensions of the first patch structure and the first triangularly-shaped slot structure primarily determine a first operating frequency band, gain of the multiple-band antenna in the first operating frequency band, and impedance of the multiple-band antenna in the first operating frequency band; and wherein dimensions of the second patch structure and the second triangularly-shaped slot structure primarily determine the second operating frequency band, gain of the multiple-band antenna in the second operating frequency band, and impedance of the multiple-band antenna in the second operating frequency band.

4. The multiple-band antenna of claim 3, wherein the first operating frequency band comprises a transmit sub-band of 880-915 MHz and a receive sub-band of 925-960 MHz; and wherein the second frequency band comprises a transmit sub-band of 1850-1910 MHz and a receive sub-band of 1930-1990 MHz.

5. The multiple-band antenna of claim 1, wherein the first patch structure further comprises an adjoining portion coupling the first and second end portions to define a substantially C-shaped structure; and wherein the second patch structure is electrically coupled to the adjoining portion.

6. The multiple-band antenna of claim 1, further comprising:

a feeding point electrically coupled to the second end portion and positioned to overlap the second end portion; and a ground point electrically coupled to the second patch structure and positioned to overlap the second patch structure.

7. The multiple-band antenna of claim 6, wherein the first patch structure further comprises a bent portion electrically coupling the feeding point to the second end portion; and wherein the second patch structure comprises a bent portion electrically coupling the ground point to the second patch structure.

8. The multiple-band antenna of claim 1, further comprising:

a fine tuning tab connected to the second portion of the first patch structure;

a pair of fine tuning tabs connected to the first portion of the first patch structure; and a tuning slot disposed between the pair of fine tuning tabs in the first portion of the first patch structure.

9. A wireless mobile communication device comprising:

a housing;

at least one wireless transceiver carried by the housing; and a multiple-band antenna carried by the housing and connected to the at least one wireless transceiver, the multiple-band antenna comprising a first patch structure comprising spaced apart first and second end portions, a second patch structure electrically coupled to the first patch structure between the first and second end portions thereof, a first triangularly-shaped slot structure disposed between the first end portion of the first patch structure and the second patch structure, the first triangularly-shaped slot structure having an apex portion and an opposing base portion, a second triangularly-shaped slot structure disposed between the second end portion of the first patch structure and the second patch structure, the second triangularly-shaped slot structure having an apex portion and an opposing base portion, and a second rectangularly-shaped slot structure coupled to the apex portion of the second triangularly-shaped slot structure.

10. The wireless mobile communication device of claim 9, further comprising a first rectangularly-shaped slot structure coupled to the apex portion of the first triangularly-shaped slot structure; and wherein the first rectangularly-shaped slot structure is smaller in area than the second rectangularly-shaped slot structure.

11. The wireless mobile communication device of claim 9, wherein dimensions of the first patch structure and the first triangularly-shaped slot structure primarily determine a first operating frequency band, gain of the multiple-band antenna in the first operating frequency band, and impedance of the multiple-band antenna in the first operating frequency band; and wherein dimensions of the second patch structure and the second triangularly-shaped slot structure primarily determine the second operating frequency band, gain of the multiple-band antenna in the second operating frequency band, and impedance of the multiple-band antenna in the second operating frequency band.

12. The wireless mobile communication device of claim 11, wherein the first frequency band comprises a transmit sub-band of 880-915 MHz and a receive sub-band of 925-960 MHz; and wherein the second frequency band comprises a transmit sub-band of 1850-1910 MHz and a receive sub-band of 1930-1990 MHz.

13. The wireless mobile communication device of claim 9, wherein the first patch structure further comprises an adjoining portion coupling the first and second end portions to define a substantially C-shaped structure; and wherein the second patch structure is electrically coupled to the adjoining portion.

14. The wireless mobile communication device of claim 9, further comprising:

a feeding point electrically coupled to the second end portion and positioned to overlap the second end portion; and a ground point electrically coupled to the second patch structure and positioned to overlap the second patch structure.

15. The wireless mobile communication device of claim 14, wherein the first patch structure further comprises a bent portion electrically coupling the feeding point to the second end portion; and wherein the second patch structure comprises a bent portion electrically coupling the ground point to the second patch structure.

16. The wireless mobile communication device of claim 9, wherein the multiple-band antenna is mounted in the housing adjacent top and rear surfaces thereof.

17. The wireless mobile communication device of claim 9, further comprising at least one of a keyboard, a display, a speaker, and a microphone carried by the housing on a front surface thereof.

18. The wireless mobile communication device of claim 9, further comprising:

a fine tuning tab connected to the second portion of the first patch structure;

a pair of fine tuning tabs connected to the first portion of the first patch structure; and a tuning slot disposed between the pair of fine tuning tabs in the first portion of the first patch structure.

19. The wireless mobile communication device of claim 9, wherein the at least one wireless transceiver is for at least one of data and voice operation.

20. A method for making a multiple-band antenna comprising:

forming a first patch structure comprising spaced apart first and second end portions;

forming a second patch structure electrically coupled to the first patch structure between the first and second end portions thereof;

forming a first triangularly-shaped slot structure disposed between the first end portion of the first patch structure and the second patch structure, the first triangularly-shaped slot structure having an apex portion and an opposing base portion;

forming a second triangularly-shaped slot structure disposed between the second end portion of the first patch structure and the second patch structure, the second triangularly-shaped slot structure having an apex portion and an opposing base portion; and forming a second rectangularly-shaped slot structure coupled to the apex portion of the second triangularly-shaped slot structure.

21. The method of claim 20, further comprising forming a first rectangularly-shaped slot structure coupled to the apex portion of the first triangularly-shaped slot structure; and wherein the first rectangularly-shaped slot structure is smaller in area than the second rectangularly-shaped slot structure.

22. The method of claim 20, wherein dimensions of the first patch structure and the first triangularly-shaped slot structure primarily determine a first operating frequency band, gain of the multiple-band antenna in the first operating frequency band, and impedance of the multiple-band antenna in the first operating frequency band; and wherein dimensions of the second patch structure and the second triangularly-shaped slot structure primarily determine the second operating frequency band, gain of the multiple-band antenna in the second operating frequency band, and impedance of the multiple-band antenna in the second operating frequency band.

23. The method of claim 22, wherein the first operating frequency band comprises a transmit sub-band of 880-915 MHz and a receive sub-band of 925-960 MHz; and wherein the second frequency band comprises a transmit sub-band of 1850-1910 MHz and a receive sub-band of 1930-1990 MHz.

24. The method of claim 20, wherein forming the first patch structure further comprises forming an adjoining portion coupling the first and second end portions to define a substantially C-shaped structure; and wherein the second patch structure is electrically coupled to the adjoining portion.

25. The method of claim 20, further comprising:

forming a feeding point electrically coupled to the second end portion and positioned to overlap the second end portion; and forming a ground point electrically coupled to the second patch structure and positioned to overlap the second patch structure.

26. The method of claim 25, wherein forming the first patch structure further comprises forming a bent portion electrically coupling the feeding point to the second end portion; and wherein forming the second patch structure comprises forming a bent portion electrically coupling the ground point to the second patch structure.

27. The method of claim 20, further comprising:

forming a fine tuning tab connected to the second portion of the first patch structure;

forming a pair of fine tuning tabs connected to the first portion of the first patch structure; and forming a tuning slot disposed between the pair of fine tuning tabs in the first portion of the first patch structure.

* * * * *